United States Patent [19]

Tipton et al.

[11] Patent Number: 4,527,490

[45] Date of Patent: Jul. 9, 1985

[54] KNOCKDOWN SHELVING ASSEMBLY

[75] Inventors: Larry J. Tipton, Florissant; Larry D. Alfermann, Washington, both of Mo.

[73] Assignee: Bastian Advanced Systems, Inc., St. Louis, Mo.

[21] Appl. No.: 496,643

[22] Filed: May 20, 1983

[51] Int. Cl.[3] ..... A47B 3/00

[52] U.S. Cl. ..... 108/111; 108/64; 108/108

[58] Field of Search ..... 108/111, 107, 108, 109, 108/91, 94; 403/1, 168, 235, 240, 242, 263, 280, 282; 248/345.1, 412

[56] References Cited

U.S. PATENT DOCUMENTS

| | | | |
|---|---|---|---|
| 449,337 | 4/1891 | Jackson . | |
| 644,781 | 3/1900 | Stephenson . | |
| 689,855 | 12/1901 | Copeland . | |
| 1,270,976 | 7/1918 | Schade . | |
| 1,576,881 | 3/1926 | Vitek . | |
| 2,364,191 | 12/1944 | Campbell | 297/349 |
| 2,705,119 | 3/1955 | Ingwer . | |
| 2,919,941 | 1/1960 | Bohlman et al. . | |
| 2,944,780 | 7/1960 | Monk | 108/111 X |
| 3,041,715 | 7/1962 | Norton | 29/417 |
| 3,182,846 | 5/1965 | La Kaff | 220/4 |
| 3,245,365 | 4/1966 | Doherty | 108/144 |
| 3,344,756 | 10/1967 | Kelson | 108/106 |
| 3,424,111 | 1/1969 | Maslow | 108/144 |
| 3,523,508 | 8/1970 | Maslow | 108/144 |
| 3,747,965 | 7/1973 | Wing | 108/111 X |
| 3,834,549 | 9/1974 | Burg et al. | 108/111 X |
| 3,985,083 | 10/1976 | Pofferi | 108/111 |
| 3,994,242 | 11/1976 | Daniberg | 108/64 |
| 4,021,128 | 5/1977 | Chaimes | 108/64 |
| 4,099,472 | 7/1978 | Kellogg | 108/64 X |

FOREIGN PATENT DOCUMENTS

| | | | |
|---|---|---|---|
| 264047 | 8/1968 | Austria | 108/111 |
| 855715 | 2/1940 | France . | |

*Primary Examiner*—James T. McCall

*Attorney, Agent, or Firm*—Sixbey, Friedman & Leedom

[57] ABSTRACT

A knockdown shelving assembly includes a cylindrical shelf supporting sleeve positioned on a shelf supporting standard. The shelf supporting sleeve and the shelf supporting standard include ramps which are in interfering engagement with each other to affix the supporting sleeve to the supporting standard, and a shelf rests on an end edge of the cylindrical shelf supporting sleeve to be supported on the supporting standard via the supporting sleeve.

16 Claims, 8 Drawing Figures

KNOCKDOWN SHELVING ASSEMBLY

TECHNICAL FIELD

The present invention relates, in general, to shelving, and more particularly, to knockdown shelving.

BACKGROUND ART

Knockdown shelving assemblies are available in many forms. One form includes knockdown shelving assemblies such as those disclosed in LaKaff U.S. Pat. No. 3,182,846 and Kelson U.S. Pat. No. 3,344,756 wherein shelves are fixed to shelf supporting standards using set screws or other such threaded fasteneing means.

The knockdown shelving assembly disclosed by LaKaff includes a shelf having an object supporting central planar portion. An engaging element is affixed to the shelf and has a conical wall defining a frusto-conical cavity with the conical wall being sloped with respect to a line perpendicular to the shelf central planar portion and diverging outwardly away from the central planar portion of the shelf. A frusto-conical male element on the end of a shelf supporting standard is received in the engaging element cavity and the shelf supporting standard is rigidly attached to the shelf mounted engaging element by means of a threaded fastener.

A cabinet formed using a LaKaff type assembly can support heavy items on the shelves without adversely affecting the knockdown feature of the cabinet. However, a LaKaff type cabinet has shelf spacing which can only be an increment of supporting standard length. There can be no intermediate shelves between shelves located at the ends of the supporting standards, and thus, shelf designs using knockdown assemblies similar to the LaKaff assembly have only a limited number of set-up designs and configurations available. Furthermore, should one of a set of supporting standards become damaged or lost, the usefulness of the remaining supporting standards is adversely affected. In a worst case, an entire shelf level may have to be omitted simply because one standard of the set of standards cannot be used.

The problems associated with incremental shelf spacing are overcome by knockdown shelving assemblies such as that disclosed by Kelson which have shelves capable of infinite adjustment along the length of a supporting standard. The Kelson knockdown shelving assembly has a cylindrical shelf supporting standard attached to individual shelves by set screws engaging the longitudinally extending wear surface of the shelf supporting standard. The supporting standards of this assembly are received through holes defined in the shelves so the shelves can be moved longitudinally along the supporting standards. A shelf can be affixed to a supporting standard at any location on that standard by means of the set screws.

While a knockdown shelving assembly similar to the Kelson assembly has shelves which are infinitely adjustable, there is a danger that the shelves will move relative to the supporting standards if very heavy items are placed on the shelves, for the shelves are held in place only by the set screws abutting the longitudinally extending surfaces of the supporting standards. The weight supported on the shelves is directed axially of the supporting standards; whereas, the shelf-standard affixing force generated by the set screws is directed radially of the supporting standards. The shelves are thus supported only by the friction forces generated at the supporting standard cylindrical outer surfaces by the set screws.

Another form of knockdown shelving assembly includes knockdown assemblies similar to those assemblies disclosed in Maslow, U.S. Pat. Nos. 3,424,111 and 3,523,508 and Pollak, French Pat. No. 855,715, wherein shelves are affixed to shelf supporting standards by elements wedgingly forced together. Such knockdown shelving assemblies provide variety in shelf spacing greater than that variety provided by the incremental spacing of the Kelson type knockdown assemblies, and yet provide an engagement between a shelf and a supporting standard which is more secure than the engagement produced by elements included in LaKaff type knockdown shelving assemblies. The Maslow and Pollak knockdown shelving assemblies include a shelf having a central object supporting plane, and an engaging element is affixed to the shelf and has a conical wall defining a frusto-conical cavity with the conical wall sloping with respect to a line perpendicular to the shelf central object supporting plane and diverging outwardly away from the shelf central object supporting plane. The Maslow and Pollak knockdown shelving assemblies include a frusto-conical male sleeve element affixed to the longitudinally extending surface of a cylindrical shelf supporting standard, by a friction fit in the Pollak assembly and by engagement of ribs into indentations or notches on the supporting standards in the Maslow assembly. The sleeves can be moved on a shelf supporting standard in the longitudinal direction of that supporting standard, and the male frusto-conical sleeve element is received in the shelf-affixed frusto-conical cavity to attach the shelf to the supporting standard via a wedging engagement between the cavity defining conical wall on the shelf and the male frusto-conical sleeve element.

The frusto-conical male element is a split sleeve in the Maslow knockdown assembly and is an elastomeric element which is deformed and compressed into a frusto-conical shape by the wedging action between the frusto-conical cavity wall and the tubular support post in the Pollak knockdown assembly. The shelves of Pollak type knockdown assemblies are infinitely adjustable on the shelf supporting standards, but are subject to movement on the supporting standards if heavy objects are placed on the shelves, as the wedged elements of this assembly include an elastomeric element which has limited ability to withstand the shelf weight generated forces.

A Maslow type knockdown shelving assembly has a metal male sleeve element used as one of the wedging elements and thus is more stable and less susceptible to shelf movement on the supporting standards than is a Pollak type shelving assembly. The tightness of fit between the shelf and the supporting standard affixed frusto-conical sleeve element of Pollak and Maslow type knockdown shelving assemblies is increased as shelf supported weight is increased. This result is desirable to provide reliable and secure shelf positioning, but presents drawbacks when the shelving assembly is knocked down. The wedging interference between the shelf supporting standard affixed frusto-conical sleeve element and the shelf affixed conical wall may be greater than can be overcome by hand. This drawback is especially evident in the Maslow type knockdown assemblies due to the metal-to-metal interference fit established between the shelf and the sleeve element. Using equipment such as hammers to remove a shelf from a supporting standard is not at all desirable as the shelf or the supporting standard may be damaged by the hammer, and the force required for separating the shelf and the supporting standard may exceed the strength of the person knocking down the shelving assembly if no hammer is available.

Accordingly, there is need for a knockdown shelving assembly which will securely and reliably support heavy objects in a multiplicity of positions, yet which will permit a shelf to be easily disassembled from a shelf supporting standard.

DISCLOSURE OF THE INVENTION

It is a primary object of the present invention to provide a novel and improved knockdown shelving assembly which has shelves securely supported on shelf supporting standards but which can be easily removed from such shelf supporting standards even if the shelves have been heavily loaded at any time. A cylindrical sleeve is affixed to a shelf supporting standard and a shelf rests on one end of the sleeve. There is no wedging type fit established between the shelf and any other element of the knockdown shelving assembly.

It is another object of the present invention to provide a novel and improved knockdown shelving assembly in which a shelf with an aperture defined therein is provided with a collar plate attached to the shelf with a hole defined therein to be aligned with the shelf aperture. The collar plate hole is larger than the shelf aperture so a shelf supporting standard having a cylindrical shelf supporting sleeve thereon can be easily received through the aligned hole and aperture with the shelf resting on an end edge of the cylindrical shelf supporting sleeve without any wedging fit between the shelf and any other element of the shelving assembly.

It is yet another object of the present invention to provide a novel and improved knockdown shelving assembly which has bumpers on the corners of a shelf to protect that shelf from being marred by contact with other objects. If the shelving assembly is mounted on casters and is moved, the bumpers protect not only the shelf, but other objects as well which may be contacted by the movable shelving assembly.

It is a further object of the present invention to provide a novel and improved knockdown shelving assembly having knockouts located along the length of a shelf. The knockouts permit shelves to be fastened together without gaps to vary the configuration of the knockdown shelving assembly.

A still further object of the present invention is to provide a novel and improved knockdown shelving assembly wherein a shelf is adjustably supported on a corner supporting standard by the radial expansion of a cylindrical sleeve into contact with the annular edge of an aperture in which the sleeve is received.

BEST MODE FOR CARRYING OUT THE INVENTION

Figure 2:
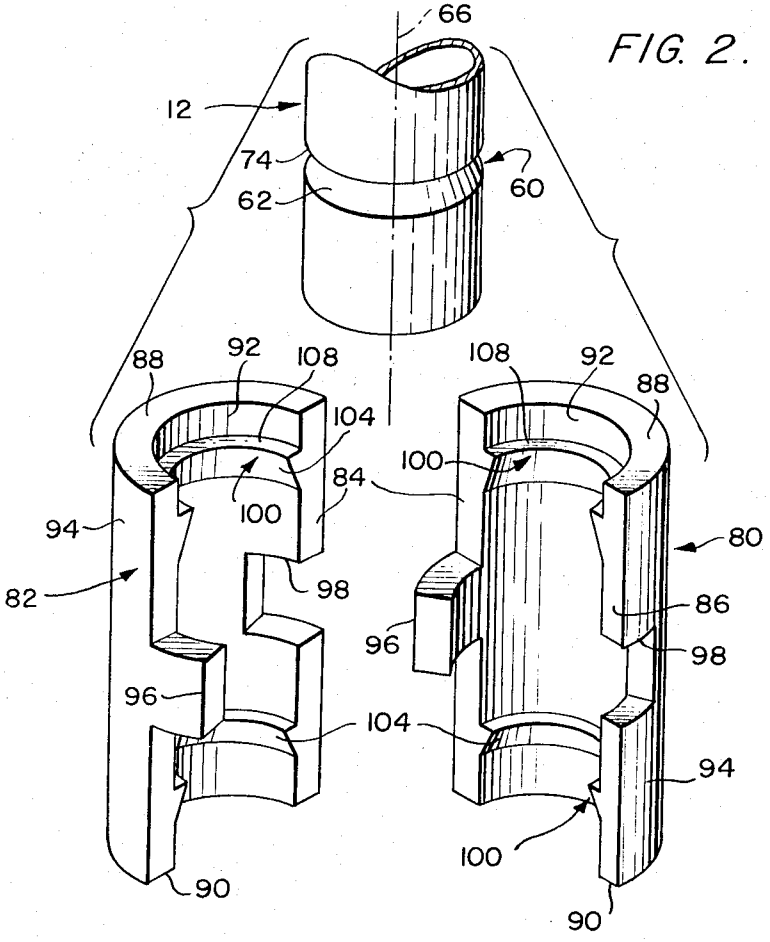
FIG. 2 is an exploded perspective view of a portion of a knockdown shelving assembly embodying the teachings of the present invention.

Referring now to the drawings, the knockdown shelving assembly of the present invention includes a plurality of shelves, one of which is indicated at 10, adjustably mounted on a plurality of shelf supporting standards, such as shelf supporting standard 12, by a plurality of tubular shelf supporting sleeves 14. The shelving assembly of the present invention can include one or more shelves suitably spaced apart, and the shelf supporting standards can be on casters if desirable. Only one shelf supporting sleeve and only a portion of one shelf and shelf supporting standard are shown for the purposes of illustration, but it should be understood that the structure disclosed is provided at each corner of each shelf used in the assembly. Thus a plurality of spaced shelves are supported on four standards 12; one of which is provided at each corner of a shelf.

Figure 4:
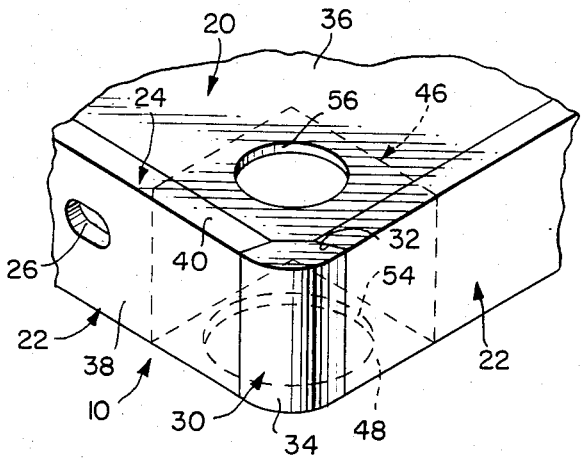
FIG. 4 is a perspective view of a shelf used in the knockdown shelving assembly embodying the teachings of the present invention.

As best shown in FIG. 4, the shelf 10 includes a planar object supporting central portion 20 having side flanges 22 connected thereto by sloping connecting portions 24. Knockout portions, such as knockout portion 26, are defined in the side flanges so that separate shelves can be connected together to provide more object supporting area, or to vary the configuration of the knockdown shelving assembly. For example, using fasteners such as nuts and bolts, a plurality of shelves 10 can be connected together to form "T" or "L" configurations, or abutted together to lengthen or widen an object supporting area without gaps being formed between such connected shelves. The presence of gaps between connected shelves creates spillage problems and makes it difficult to keep a shelving assembly clean.

A bumper 30 is attached to the shelf 10 at each corner of the shelf in a corner opening 32, and has an outer surface 34 spaced from surfaces 36, 38 and 40 of the shelf planar central portion 20, side flanges 22 and sloping connecting portions 24 respectively. The bumper 30 protects a shelf from being damaged by contact with other objects. The bumpers may be sized and formed to permit the shelves to be stacked, as properly designed bumpers of stacked shelves will be in contact with each other in a manner which absorbs much of the contact between those stacked shelves. Such properly designed bumpers also act as spacers between stacked shelves in addition to protecting those stacked shelves.

Figure 1:
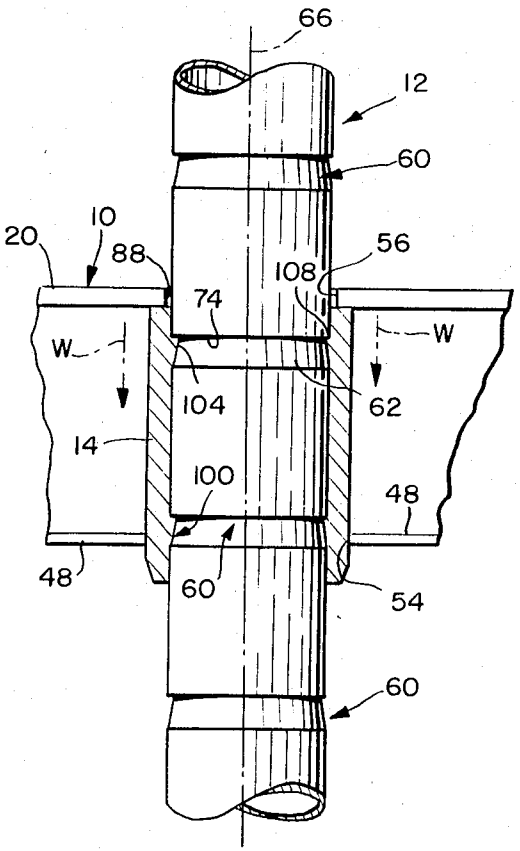
FIG. 1 is a sectional view of a portion of a knockdown shelving assembly embodying the teachings of the present invention.

A brace or corner gusset member 46 is located on the shelf 10 at each shelf corner and includes a collar plate 48 having a hole 54 defined therethrough. The collar plate is spaced from the shelf central portion 20, and the hole 54 is centrally aligned with and has a diameter larger than a hole 56 defined through the shelf central portion 20. The shelf supporting standard 12 is received through the aligned holes 54 and 56 as best shown in FIG. 1.

Figure 5:
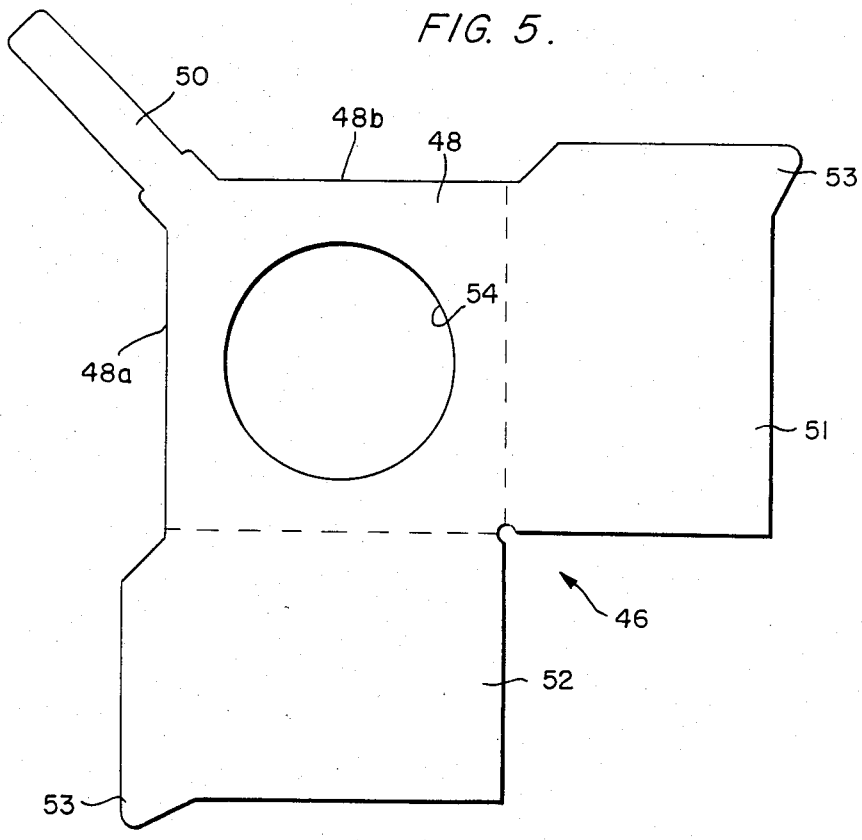
FIG. 5 is a plan view of a blank used to form a corner gusset for the shelves used in the present invention.
Figure 6:
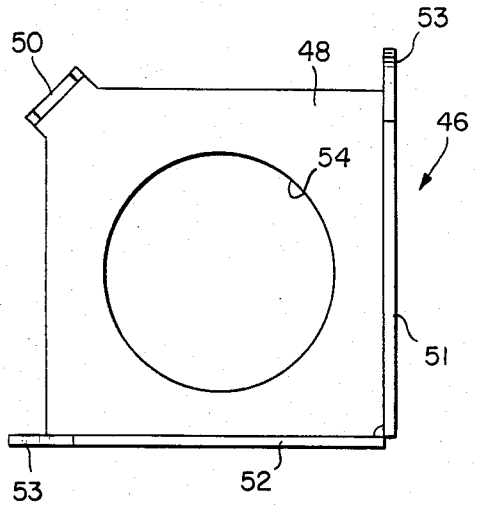
FIG. 6 is a plan view of the assembled corner gusset of FIG. 5.
Figure 7:
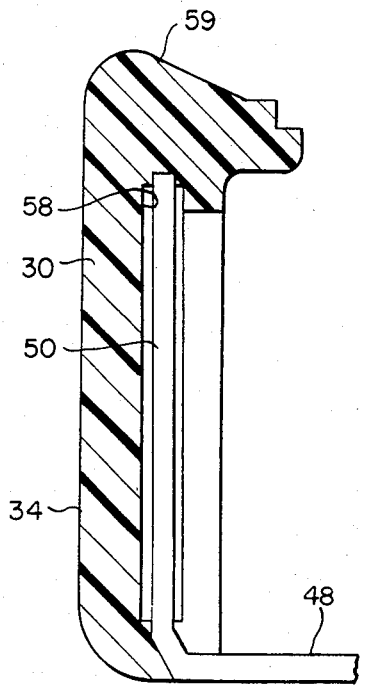
FIG. 7 is a sectional view of the corner bumper structure for a shelf used with the present invention.

The corner gusset 46 which is secured to the underside of each shelf 10 at each corner thereof is best illustrated in FIGS. 5–7. When the downwardly depending flanges 22 are formed in the shelf 10, a substantially "V" shaped opening 32 is formed at the corner between adjacent flanges extending away from the corner. The corner gusset 46 includes a tongue 50 which extends upwardly from the collar plate 48 substantially centrally of the corner opening 32 to receive and support the bumper 30.

With reference to FIGS. 5 and 6, the corner gusset 46 includes two side plates 51 and 52 which extend from the collar plate 48 and which are bent upwardly to form supporting sides at right angles along two sides of the collar plate. The upper extremity of the free ends of each of the side plates is provided with an angled projection 53 which fits into the recess provided by the sloping connecting portion 24 when the corner gusset is secured to the underside of the shelf 10. This is accomplished by positioning the corner gusset so that the upper edges of the side plates 51 and 52 rest against the underside of the shelf 10 with the tongue 50 projecting upwardly from the collar plate 48 in the corner opening 32. The central axis of the hole 54 is aligned so as to be substantially coextensive with the central axis of the hole 56, and the edges 48*a* and 48*b* of the collar plate 48 are then welded to the lower edges of the flanges 22.

With the corner gusset 46 secured in place at the corner of the shelf 10, the bumper 30 of rubber or other resilient material may now be inserted over the tongue 50 to fill the corner opening 32. It will be noted that the bumper is provided with a central, longitudinally extending slot or channel 58 to receive the supporting tongue 50. With the bumper in place, the outer surface 34 thereof provides a rounded, cushioned corner at each corner of the shelf 10, and the upper surface 59 of the bumper projects above the uppermost extremity of the shelf 10 to provide corner cushions when shelves are stacked.

Figure 3:
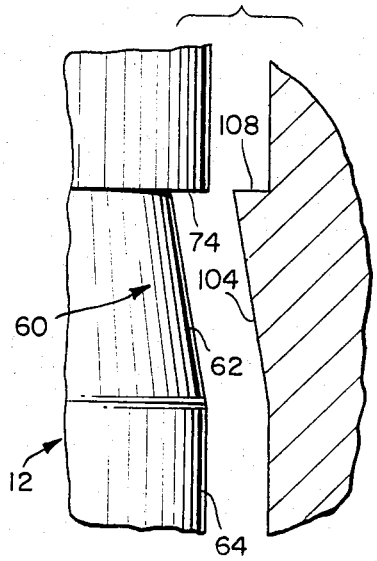
FIG. 3 is a sectional view of a portion of a shelf supporting sleeve and a shelf supporting standard embodying the teachings of the present invention.

Each shelf supporting standard 12 is cylindrical and has a plurality of circumferentially extending notches, such as notch 60, defined therein to be spaced apart longitudinally along the extent of the supporting standard 20. The notches are located on the supporting standard 20 so that various positions for the shelf 10 can be selected. The configuration of a notch 60 is best shown in FIG. 3, and includes a notch ramp 62 sloping in the axial direction from outer surface 64 of the supporting standard 12 inwardly of the supporting standard toward a supporting standard center line 66. A shoulder 74 extends from the supporting standard outer surface 64 radially inwardly of the cylindrical supporting standard toward the supporting standard center line 66 to meet the notch ramp 62 at its innermost extremity. As will be discussed below, the notch 60 and the elements forming the notch are used to support a shelf on the supporting standard without requiring a wedge fit between the shelf 10 and any other element of the knock-down shelving assembly.

The shelf supporting sleeve 14 is shown in FIGS. 1 and 2. An assembled sleeve will include a pair of semi-cylindrical sleeve portions 80 and 82 each having a pair of longitudinally extending side edges 84 and 86 and a pair of end edges 88 and 90 as well as a semi-cylindrical inner surface 92 and a semi-cylindrical outer surface 94. The semi-cylindrical sleeve portions 80 and 82 fit around a shelf supporting standard and are sized to be coextensive and to abut each other at longitudinally extending side edges 84 and 86 to form the tubular sleeve 14. These sleeve portions may be provided with opposed projecting fingers 96 and grooves 98 to aid in aligning the mating sleeve portions.

The cylindrical sleeve inner surface 92 corresponds to the cylindrical shape of the shelf supporting standard 12, and the cylindrical sleeve outer surface is of a diameter which is greater than the diameter of the shelf hole 56 but smaller than the diameter of the collar plate hole 54. Tapered circumferentially extending flanges 100 are formed on sleeve portion inner surfaces 92 and are spaced apart in the longitudinal direction of an assembled supporting sleeve 14 for a distance corresponding to the spacing between adjacent notches 60 on the supporting standard 12. Each flange 100 includes a ramp 104 extending in the longitudinal direction of the cylindrical sleeve portion and sloping outwardly from sleeve inner surface 92. A shoulder 108 extends from the sleeve inner surface 92 radially outwardly to the outermost extremity of the ramp 104. The ramp 104 and shoulder 108 are sized to correspond to shelf supporting standard ramp 62 and shelf supporting standard shoulder 74 respectively, so a sleeve flange 100 is accommodated in weight supporting relationship in a supporting standard notch 60 when the supporting sleeve 14 is positioned on a shelf supporting standard 12 as shown in FIG. 1.

In the assembled configuration shown in FIG. 1, the semi-cylindrical portions 80 and 82 are in coextensive side edge abutting contact with each other and form the tubular sleeve 14 which surrounds the shelf supporting standard 12. The flanges 100 are received in corresponding notches 60 with ramps 104 contacting corresponding notch ramps 62, and the sleeve upper edge 88 supports the shelf 10 adjacent to the shelf hole 56. The cylindrical outer sufface of the sleeve engages the annular edge of the collar plate hole 54 to hold the sleeve portions 80 and 82 together in position on the shelf supporting standard 12.

The shelf 10 is supported by resting on the shelf supporting sleeve end edge 88, and the shelf supporting sleeve 14 is supported on the shelf support standard 12 by engagement of the sleeve ramps 104 with corresponding notch ramps 62. In the assembled configuration, the ramps 62 and 104 are both angled and oriented with respect to the supporting standard center line 66 so shelf weight W tends to force the sleeve ramps 104 to slide downwardly along notch ramps 62. This results in a camming action which forces the sleeve sections 80 and 82 apart, thus causing a radially outwardly directed force which forces the cylindrical outer surface of the sleeve 14 into tight engagement with the circular edge of the hole 54.

It is important to note in FIG. 1 that there is no wedging action present between extensive frusto-conical sleeve and shelf surfaces in the shelf assembly of the present invention as was prevalent in the prior art. Instead, an effective interference fit between the cylindrical outer surface of the sleeve 14 and the annular edge of the hole 54 is achieved by radially expanding the sleeve in a direction substantially perpendicular to the central longitudinal axis of the sleeve. The radial force applied to the sleeve 14 is a function of the weight applied to the shelf 10, and accordingly, the engagement between the sleeve and the crown plate 48 increases with weight. The diameter of the hole 54 in the crown plate is sufficient to permit the sleeve ramp 104 to move downwardly along the supporting standard ramp 62 in response to weight on the shelf 10, but is not sufficient to permit the flange 100 to move out of the notch 60. The camming ramp surfaces 62 and 104 are of an extent sufficient to insure a tight assembly when the shelf 10 and collar 14 are assembled with the supporting standards 12, but these surfaces are not of sufficient extent to lockingly wedge together and prevent dissassembly of the shelving unit. Instead, upward pressure on the shelf 10 and/or the bottom of the sleeve 14 causes the ramp 104 to slide up the ramp 62, and the half sections of the sleeve move radially inwardly. Since there is no wedging action between the cylindrical outer surface of the sleeve and the edge of the hole 54, the sleeve may be readily disengaged from the crown plate 48. In fact, the annular edge of the hole 54 provides a minimal contact surface with the sleeve to positively prevent any wedging action between the two. This annular edge contains the radially expanding sleeve to provide a tight fit, but there is no wedging between these elements to inhibit disassembly.

The supporting sleeve 14 is preferably formed of a plastic material having a material memory, so that once the loading on the shelf and the sleeve is reduced, the material memory of the sleeve will tend to force the sleeve into a position where reduced interference occurs between the ramps 62 and 104. The sleeve material will thus assist in the removal of the sleeve 14 from the supporting standard 12 by creating a force in the sleeve removal direction.

Any number of notches 60 and any number of flanges 100 can be used, and the spacing between flanges 100 need not equal the spacing between notches 60 so a multiplicity of shelf positions and spacing can be selected as required. Preferably, the notches have cross-sectional shapes which define right triangles at the side edges 84 and 86 as best shown in FIG. 2.

Figure 8:
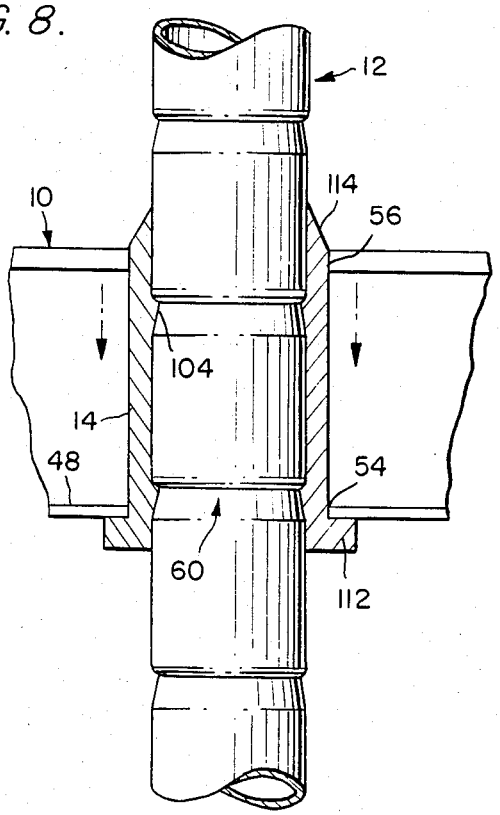
FIG. 8 is a sectional view of a second embodiment of a portion of the knockdown shelving assembly.

FIG. 8 discloses a modification of the unit of FIG. 1 wherein the shelf central portion 20 has been provided with a hole 56 which is equal in diameter to the diameter of the hole 54 in the collar plate 48. This permits the cylindrical body of the shelf supporting sleeve 14 to pass through both holes 54 and 56, and an outwardly extending flange 112 is formed at the lower extremity of the shelf supporting sleeve to engage the lower surface of the collar plate 48. Thus the weight of the shelf 10 is applied to the flange 112, and the shelf supporting sleeve 14 expands against the inner edges of the holes 54 and 56. The shelf supporting sleeve in FIG. 8 is bevelled at 114 adjacent the upper edge thereof to permit the shelf 10 to be lowered over the shelf supporting sleeve once the semi-cylindrical sleeve portions 80 and 82 have been assembled around the shelf supporting standard 12.

STATEMENT OF INDUSTRIAL APPLICABILITY

The knockdown shelving assembly of the present invention may be easily assembled and disassembled, and may also be formed into a plurality of configurations in accordance with diverse storage and space requirements. The use of camming ramps on both the shelf supporting posts or standards and the shelf supporting sleeves to expand the sleeves radially against a shelf corner support provides an effective support function without the disassembly difficulties sometimes experienced with wedging support units.

We claim:

1. A knockdown shelving assembly comprising a shelf member having corner supports secured thereto at each corner thereof, each said corner support including an opening having an annular edge, said opening being adapted to receive an elongated shelf supporting post, each said corner support including gusset means secured to said shelf member at each corner thereof, said gusset means including a crown plate spaced from said shelf member and extending substantially parallel thereto, said opening being formed in said crown plate, and an expandable shelf supporting post within said opening for limited longitudinal movement relative to said shelf supporting post, said shelf supporting post including cam means operative upon longitudinal movement of said supporting sleeve means to engage and expand said expandable shelf supporting sleeve means outwardly from said shelf supporting post against the annular edge of said opening.

2. The knockdown shelving assembly of claim 1 wherein a shelf opening is formed in each corner of said shelf member, said shelf opening being smaller than the opening in said crown plate and substantially aligned therewith.

3. The knockdown shelving assembly of claim 2 wherein said shelf opening is of sufficient size to receive said elongated shelf supporting post but of insufficient size to receive said expandable shelf supporting sleeve means.

4. The knockdown shelving assembly of claim 3 wherein said expandable shelf supporting sleeve means, when mounted on an elongated shelf supporting post, engages and supports said shelf member.

5. The knockdown shelving assembly of claim 1 wherein a bumper mounting means extends from said crown plate adjacent a corner of said shelf member and resilient bumper means is mounted upon said bumper mounting means.

6. The knockdown shelving assembly of claim 5 wherein said shelf member includes a planar support surface and said resilient bumper means extends outwardly from said shelf member at each corner thereof and upwardly above said planar support surface.

7. A knockdown shelving assembly comprising:

a shelf having an opening defined therein:

a collar plate affixed to said shelf and having an aperture defined therein to be spaced from and aligned with said shelf opening, an elongated shelf supporting standard adapted to be received in said aligned shelf opening and collar plate aperture, said shelf supporting standard including notches spaced apart longitudinally of said supporting standard, each of said notches having a notch shoulder extending radially inwardly of said supporting standard and a ramp angled with respect to a shelf supporting standard center line and intersecting said notch shoulder;

a shelf supporting sleeve adapted to surround said supporting standard, said shelf supporting sleeve including an end edge, a sleeve outer surface, a sleeve inner surface and a plurality of projections on said sleeve inner surface, said projections each including a sleeve projection shoulder extending radially inwardly of said sleeve and a sleeve projection ramp angled with respect to a sleeve center line inwardly of said sleeve and intersecting said sleeve projection shoulder, said sleeve projections corresponding in shape to said supporting standard notches and adapted to be received therein with said supporting sleeve ramps engaging said supporting standard notch ramps to hold said tubular shelf supporting sleeve in position on said shelf supporting standard and said shelf abutting said sleeve end edge to rest on said supporting sleeve to be supported on said shelf supporting standard.

8. The knockdown shelving assembly defined in claim 7 wherein said tubular shelf support sleeve is flexible.

9. The knockdown shelving assembly defined in claim 7 wherein said collar plate aperture is larger than said shelf opening.

10. The knockdown shelving assembly defined in claim 7 wherein said tubular shelf supporting sleeve includes a pair of semi-cylindrical portions.

11. The knockdown shelving assembly defined in claim 7 wherein said sleeve projections are triangular in cross sectional shape.

12. The knockdown shelving assembly defined in claim 11 wherein said triangular projections are right triangles.

13. The knockdown shelving assembly defined in claim 7 further including bumpers on said shelf.

14. The knockdown shelving assembly defined in claim 7 further including knockouts on said shelf.

15. A knockdown shelving assembly comprising a shelf member having corner supports secured thereto at each corner thereof, each said corner support including an opening having an annular edge, said opening being adapted to receive an elongated shelf supporting post, and an expandable shelf supporting sleeve means mounted upon each said shelf supporting post within said opening for limited longitudinal movement relative to said shelf supporting post, said shelf supporting post and expandable shelf supporting sleeve means each including cam means formed in said shelf supporting post and said shelf supporting sleeve means by opposed, flat inclined ramp surfaces, said flat opposed, inclined ramp surfaces being in contacting, sliding relationship when said shelf supporting sleeve is mounted upon said shelf-supporting post.

16. The knockdown shelving assembly of claim 15 wherein said expandable shelf supporting sleeve means has a cylindrical configuration with a cylindrical outer surface for contacting the annular edge of said opening, said opening being circular and of a diameter greater than the diameter of said expandable shelf supporting sleeve means before the expansion thereof.

* * * * *